US005816010A

United States Patent [19]

Conn

[11] Patent Number: 5,816,010

[45] Date of Patent: Oct. 6, 1998

[54] INTERCONNECTING CONSTRUCTION PANELS

[76] Inventor: James H. Conn, 374 County Rd. 184, Crane Hill, Ala. 35053

[21] Appl. No.: 821,811

[22] Filed: Mar. 24, 1997

[51] Int. Cl.[6] ..... E04C 3/00

[52] U.S. Cl. ..... 52/588.1; 52/177; 52/480

[58] Field of Search ..... 52/528, 529, 539, 52/588.1, 177, 480

[56] References Cited

U.S. PATENT DOCUMENTS

| | | | |
|---|---|---|---|
| 3,238,687 | 3/1966 | Tisbo | 52/528 |
| 3,420,082 | 1/1969 | Barker | 52/588.1 |
| 3,555,762 | 1/1971 | Costanzo, Jr. | 52/588.1 |
| 3,608,263 | 9/1971 | Gartner | 52/588.1 |
| 4,122,643 | 10/1978 | Hafner | 52/529 X |
| 5,050,362 | 9/1991 | Tal et al. | 52/588.1 |
| 5,185,193 | 2/1993 | Phenecie et al. | 52/588.1 X |
| 5,527,128 | 6/1996 | Rope et al. | 52/588.1 X |
| 5,647,184 | 7/1997 | Davis | 52/588.1 X |

*Primary Examiner*—Christopher Kent
*Assistant Examiner*—Yvonne Horton-Richardson
*Attorney, Agent, or Firm*—John C. Garvin, Jr.; James E. Staudt

[57] ABSTRACT

A longitudinally extending construction panel is adapted to interconnect with a like panel to form a waterproof connection. A leverage arrangement including a fulcrum adjacent mating surfaces of the panels is utilized to seat the mating surfaces. Rotation of a panel about the fulcrum permits the mating surfaces to be pressed together with a force sufficient to deform the contact surfaces together to provide a water-tight seal therebetween. The width of the rotated panel provides a lever arm to aid in application sufficient force to accomplish the sealing effect. The fulcrum in cooperation with a support leg and a base plate, forms a water tight drain channel below the sealed contacting surfaces. Control of the dimensions of the panel permits lateral movement between assembled panels.

20 Claims, 6 Drawing Sheets

INTERCONNECTING CONSTRUCTION PANELS

BACKGROUND OF THE INVENTION

1. Field of the Invention

The invention relates generally to construction panels, and more specifically to such panels which are adapted to interconnect with one another so as to form a waterproof construction.

2. Description of the Related Art

It is well known that longitudinally extending construction panels of many configurations exist in the prior art. Some of these panels are designed to interconnect with one another. A particular problem with prior art construction panels is the fact that the fastening means utilized are typically exposed to the weather and the panels are not waterproof. The use of rubber gaskets and liquid sealers, neither of which is weather proof, has met with limited success. Even when sealing is accomplished with such means, a permanent solution is not provided. Another problem that exists with prior art construction panels is the well known tendency of panels to loosen at joints or fasteners because of expansion and contraction due to temperature changes. Yet another disadvantage in the prior art construction panels is that a large number of fasteners are required for retention of the panels to a framing network and in many instances the fasteners must pass through more than one layer of the panel material. No known art provides a panel, such as the present invention, which is adapted for interconnection with like panels so as to form a totally waterproof construction; which is unaffected by expansion and contraction; which may be quickly and easily installed with a minimum of material and labor; which is suitable for fabrication from a wide variety of materials such as aluminum and other metals, as well as vinyl and various plastics; which is well suited for the construction of floors, roofs, walls and other structures; and which is specifically configured for use as a combination waterproof floor and roof which may be attached to a basic framework without need of an additional sealing or supporting layer of construction material.

SUMMARY OF THE INVENTION

The present invention provides a longitudinally extending construction panel having a unique cross-sectional configuration. The panel provides a positive interlocking system which requires fastening to a support structure at one edge only. The fastened edge then provides support for a "free" edge upon interconnection of the panels. This feature considerably reduces installation labor and fastener expense. The panel utilizes a mating, hook-like connection means wherein the mating surfaces are forced together by relative rotation between the interconnecting panels.

A leverage arrangement is utilized whereby the force necessary to properly seat mating surfaces is easily provided during interconnection of like panels. This leverage arrangement includes a fulcrum adjacent the contacting surfaces. Rotation of a panel about the fulcrum permits the contacting surfaces to be pressed together with a force sufficient to deform the contact surfaces together so as to provide a watertight seal therebetween. Because of the large lever arm afforded by nearly the entire width of the rotated panel, the sealing of the contact surfaces is accomplished with a minimum force which may be easily provided by a person assembling the panels.

In addition, the fulcrum in cooperation with a support leg and a base plate, forms a large water tight channel immediately below the sealed contacting surfaces. Thus in the unlikely event of failure of the waterproof seal, any leakage of water would pass into the large water proof channel and be immediately drained to the end of the panel. It will be therefore appreciated that in the event of damage to the waterproof seal of assembled panels, a channel in each panel provides a fail safe backup for prevention of leakage.

To eliminate the possibility of leakage through fastener means such as screw holes or the like, the panel is configured to completely isolate such fastener means from exposure to the elements.

It is also significant that the dimensional relationship between the mating assemblies are controlled to provide a degree of movement between interconnected panels. This relative movement between the panels is provided for alignment during assembly and to permit expansion and contraction caused by temperature changes after assembly.

The panels are particularly well suited for construction of multi-level structures such as balconies decks and boat docks wherein the roof of one level also serves as the floor for the level above. The panels are also well suited for construction of roofs, walls, floors or other structures.

Accordingly, it is clear that the above mentioned features of the present invention are unique in the art, and do also overcome the shortcomings of the prior art as set forth herein above.

DESCRIPTION OF THE PREFERRED EMBODIMENT

Figure 1:
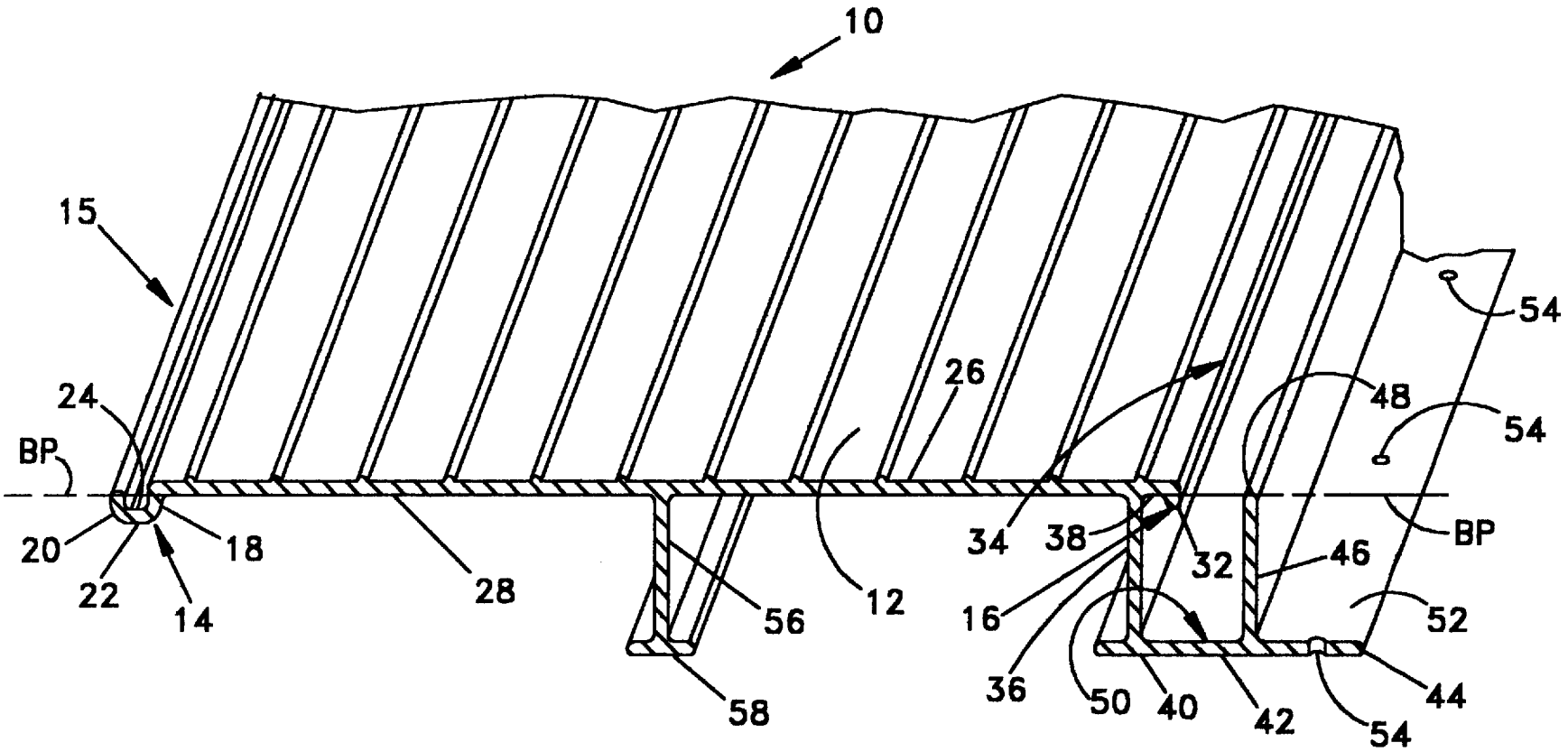
FIG. 1 is a perspective view from above, illustrating the cross-sectional configuration of a cut away portion of a construction panel which is the subject of this invention.
Figure 2:
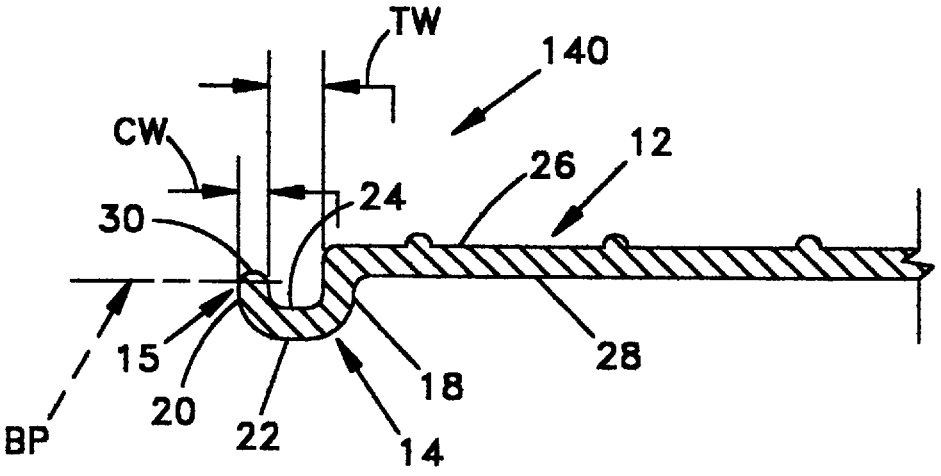
FIG. 2 is an enlarged view of an edge portion of the panel illustrated in FIG. 1.
Figure 3:
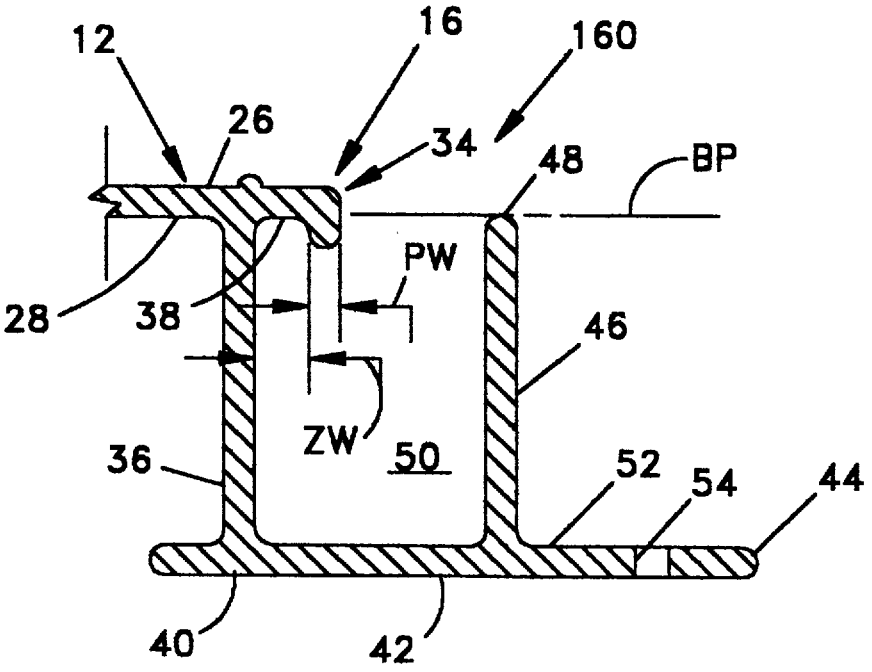
FIG. 3 is an enlarged view of an edge portion of the construction panel illustrated in FIG. 1 and illustrates an edge portion of the panel which is laterally opposite the edge portion illustrated in FIG. 2.

Referring now to the drawings, a cross section of an elongated construction panel 10, which is the subject of this invention, is best illustrated in FIG. 1. More specifically, the panel 10 includes a laterally extending platform 12 having a connector 14 and a receiver 16 spaced apart laterally and located at opposite edges of the platform. The connector 14 is positioned at a "free" edge portion 15 of the platform, which is so called because it has no closely positioned support for direct attachment to a framing network 57 (illustrated in FIGS. 4 and 5) to which the panel would be ultimately attached. As will be discussed in detail later in this specification, after assembly of like panels 10, the "free"

edge 15 will be supported by components adjacent the receiver 16. The connector 14 includes a downwardly extending shank 18, and an upwardly extending end portion 20, which are connected by a bottom portion 22 so as to form a trough 24. The platform 12 has a top surface 26 and a bottom surface 28. As illustrated in FIG. 2, which is an enlarged view of the connector 14, the bottom surface 28 defines a bottom plane BP which is an extension of the plane of the bottom surface 28. It is significant that the upwardly extending end portion 20 extends above the bottom plane BP and terminates with a contact 30. Contact 30 is adapted for engagement with the receiver portion of a panel identical to panel 10, so as to provide a sealing means in a manner which will be explained in detail hereinafter. As is also illustrated in FIG. 2, the trough 24 has a width TW, and the end portion 20 has a width CW. The significance of the widths of these components will also be explained in detail hereinafter. Referring now to FIG. 3, which is an enlarged view of the receiver 16, a protrusion 32 extends downwardly from an edge portion 34 of the platform 12. A support leg 36 is attached to the platform 12 laterally inwardly from the protrusion 32 and extends downwardly in a generally perpendicular relationship to the bottom surface 28 of the platform 10. The support leg 36 is spaced laterally inwardly from the protrusion 32 so as to provide a contact zone 38 (having the general configuration of an inverted trough) therebetween. As also illustrated in FIG. 3, the contact zone 38 has a width ZW and protrusion 32 has a width PW. The significance of these dimensions will become apparent hereinafter. An end base plate 40 is attached to the distal end of support leg 36. The base plate 40 extends laterally on either side of the support leg 36 and is generally perpendicular thereto. A base plate extension 42 extends the base plate 40 from a point generally below the protrusion 32, laterally outwardly and terminates at a base plate edge 44. A fulcrum 46 is positioned laterally outwardly from the protrusion 32 and is attached, in a generally perpendicular relation, to the base plate extension 42. Accordingly, the fulcrum 46 in cooperation with the base plate 40, the base plate extension 42 (base plate means) and the support leg 36 define a channel 50. The fulcrum 46 extends upwardly and terminates with a pivot 48 at the bottom plane BP. The portion of the base plate extension 42 which extends laterally outwardly from the fulcrum provides a fastener base 52 for accommodation of a plurality of fastener means such as apertures 54. As best illustrated in FIG. 1, one or more support brackets such as support bracket 56 may be attached to the platform 12 intermediate the connector 14 and the support leg 36 to provide support for the platform 12 as may be required for various applications of the panel 10. Support bracket 56 having a pad 58 is provided for contact with a framing network 57 (illustrated in FIGS. 4 and 5). Additional such supports may easily be added if necessary.

Figure 6:
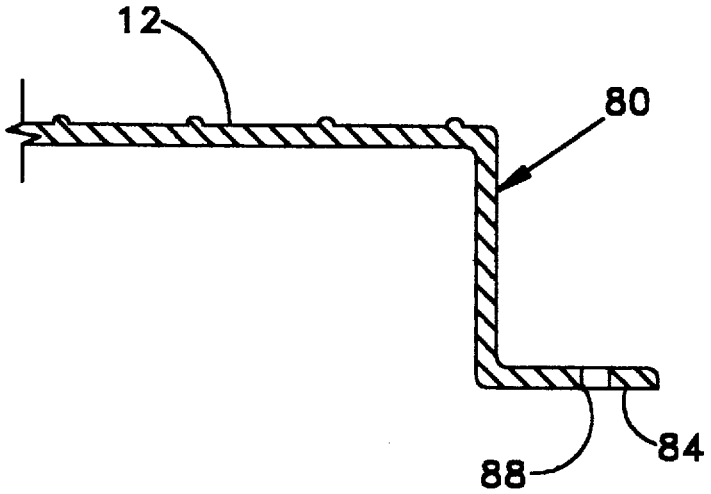
FIGS. 6 and 7 illustrate embodiments of construction panel finishing edges, utilized for providing an attractive edge for a first or final panel to be assembled.
Figure 7:
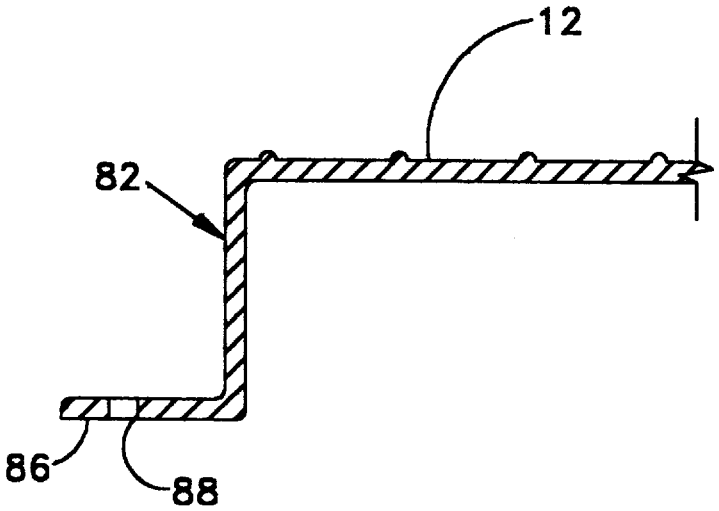

As depicted in FIGS. 2 and 3 the assemblies of the connector 14 and the receiver 16 along with the components associated therewith are referred to as a connector assembly 140 and a receiver assembly 160 respectively each being formed at opposite ends of the platform 12. As noted supra, the construction panel 10 is adapted for interconnection to panels which are identical to the described panel or with panels which include a mating assembly of either the connector or receiver configuration. For example, as illustrated in FIGS. 6 and 7, when beginning or finishing an assembly of the panels, an "L" shaped finish edge of either a right hand or left hand configuration is utilized. The appropriate finish edge is formed as a continuation of the platform 12 which would also include either a connector assembly or a receiver assembly (not shown) at the opposite edge thereof. The finish edges 80 (FIG. 6) and 82 (FIG. 7) are provided with fastener tabs 84 and 86 respectively, each of which is provided with fastener means such as apertures 88. In fastening the finish edges 80 and 82 it will be understood that if fastener means must be exposed to the elements such means will typically be positioned outside the area which is to be protected from water leakage.

Figure 4:
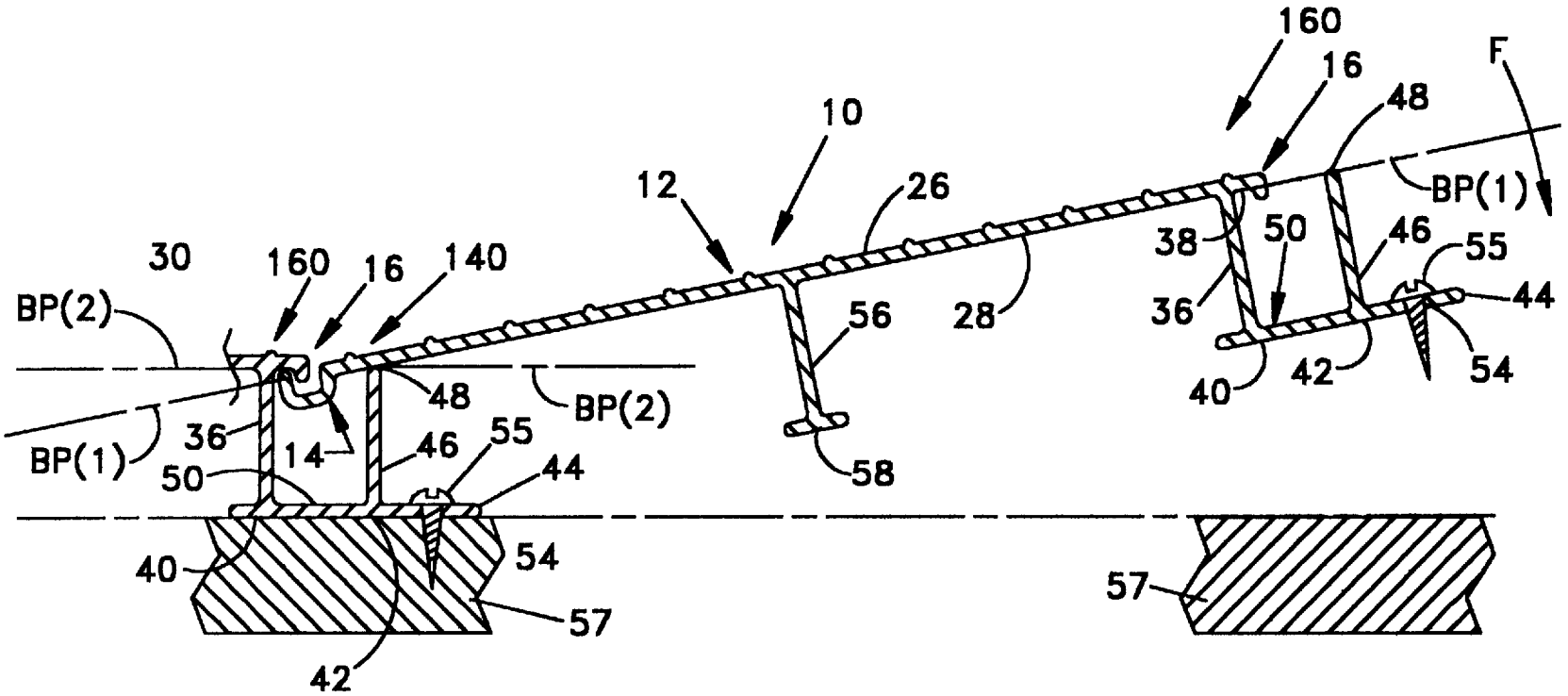
FIG. 4 is an elevational view of a first construction panel during rotational assembly to a like second construction panel which has been previously attached.
Figure 5:
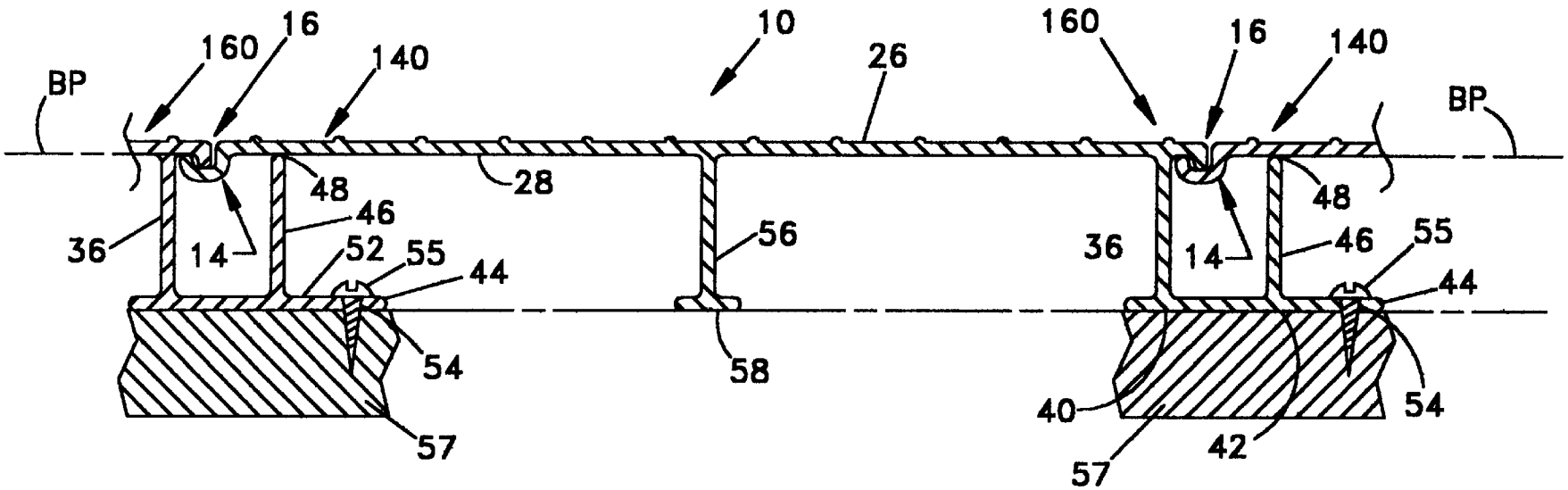
FIG. 5 is an elevational view of the construction panels as shown in FIG. 4, wherein rotation of the first panel has been completed, the first panel has been fastened, and where in a third panel has also been attached to the first panel.

Interconnection of the disclosed panel with a mating receiver or connector assembly is illustrated in FIGS. 4 and 5. For illustration, the cutaway portion of the left panel having only the receiver 16 and the fastener base 52 will be referred to as a "second" panel and will be assumed to have been previously installed to the supporting structure 57. In FIG. 4, the tilted panel which is a complete panel, shown in position for downward rotation, is referred to as a "first" panel. The first panel has been tilted at an angle sufficient to permit placement of its connector 14 beneath the receiver 16 of the second panel and has then been rotated downwardly somewhat to the point at which the contact 30 of the first panel has engaged the contact zone 38 of the second panel. It will also be noted that the fulcrum pivot 48 of the second panel has engaged the bottom surface 28 of the first panel. Accordingly, since the contact 30 of connector 14 extends well above the bottom plane BP of the first panel (see FIG. 2 for an enlarged view of contact 30), it will engage the contact zone 28 and retain the first panel in a tilted position. To complete the assembly operation, the receiver assembly 160 of the first panel is rotated downwardly to a position wherein the base plane of the first panel is aligned with the base plane of the second panel. This rotation is accomplished by application of a rotational downward force F to the receiver assembly 160 of the first panel. This force is typically applied by installation personnel until screws 55 make contact with framing network 57 to which the panels are to be attached. As will be readily understood, insertion of screws 55 will continue the downward rotation of the receiver assembly 160 of the first panel to its final position as illustrated in FIG. 5. Of great significance is the fact that contact 30 of the connector 14 engages the receiver contact zone 38 before the bottom planes BP of the first and second panels reach alignment. It will be understood that as the first panel rotates about the pivot 48, the contact 30 will be pressed against the contact zone 38 with a great deal of force. This force will cause considerable deformation of the surface of the contact 30 and because of the configuration of the contact zone 38 a lesser deformation thereof. At least one of the contacting surfaces (contact 30 and contact zone 38) are thus deformed so as to form an effective water tight seal therebetween. Since the distance from the fulcrum 46 to the connector 14 is short as compared to the distance from the fulcrum to the receiver edge 16 of the first panel, it will be appreciated that the downward force F required at the receiver edge 16 will be minimal because of the leverage differential. Also of significance is the fact that during rotation of the first panel a slight bending of the platform 12 will occur between the fulcrum 48 and the contact 30. This bending force provides a constant application of force between the mating contact 30 and the contact zone 38, so as to insure the retention of the waterproof seal which if formed therebetween under conditions which may cause relative movement between the panels.

Figure 8:
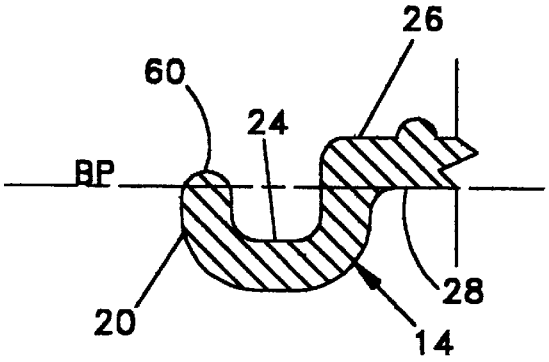
FIGS. 8–12 each illustrate an embodiment of the contact portion of a construction panel.
Figure 9:
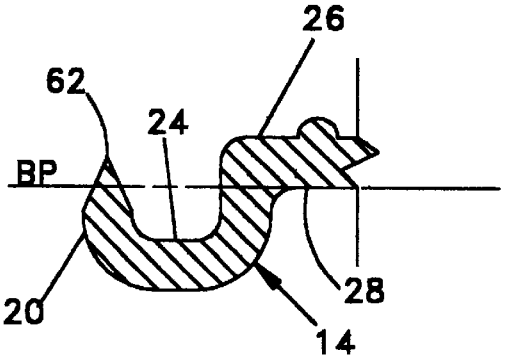
Figure 10:
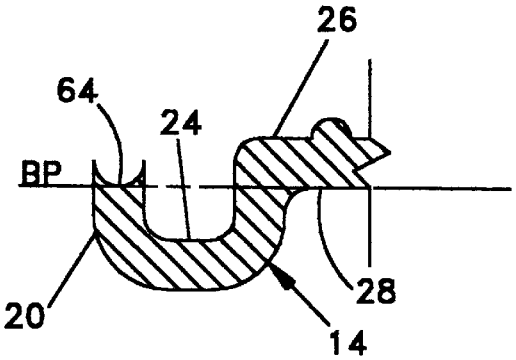
Figure 11:
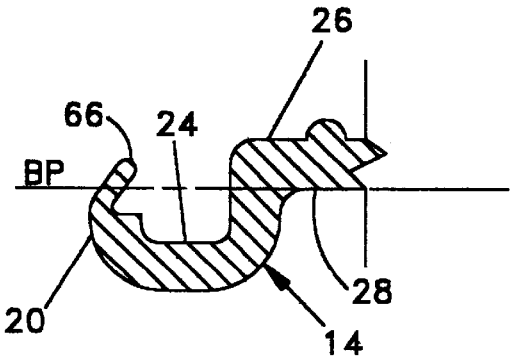
Figure 12:
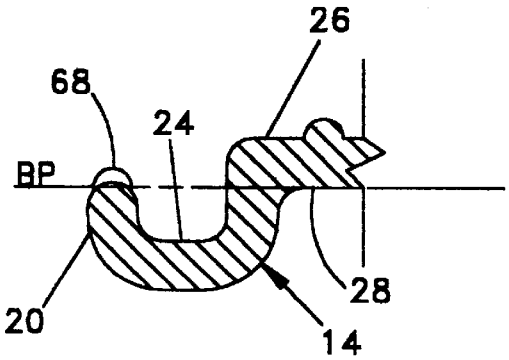

The degree of deformation of the contact 30 will be determined by its configuration and the material from which it is formed. In this regard, FIGS. 8 through 12 illustrate examples of contact configurations. While each configuration provides an effective waterproof seal, it is apparent that the application for which a panel is intended would typically dictate the required material as well as the appropriate contact configuration. FIG. 8 illustrates a dome shaped contact 60 which is suitable for most applications and is well suited for use with conventional aluminum materials typically used in building construction. FIG. 9 illustrates a contact configuration wherein a narrow upwardly extending generally tapered rib 62 is provided to permit a greater depth of the material to be deformed. It is noted the width and taper of the rib is much less than that of the upwardly extending end portion 20. To control the force required to crush the contact, the height and configuration of the contact may be varied to accommodate the characteristics of the panel material. FIG. 10 illustrates a contact configuration wherein a pair of triangular shaped ribs provide a dual sealing means. FIG. 11 provides an easily deformed flap 66. FIG. 12 illustrates a contact configuration wherein a sealing material 68 has been applied to serve at least in part as the contact.

Referring to FIG. 2, attention is again directed to the dimensional designations of the connector 14 wherein dimensions CW and TW designate the widths of the upwardly extending end portion 20 and the trough 24 respectively. Referring to FIG. 3, attention is directed to the dimensional designations of the receiver 16 wherein dimensions PW and ZW designate the widths of the protrusion 32 and contact zone 38 respectively. It is significant that the dimensional relationship between the mating assemblies be controlled to provide a degree of movement between interconnected panels. This relative movement between the panels is required for alignment during assembly and to permit expansion and contraction caused by temperature changes after assembly. Accordingly, it is required that the width ZW of the receiver contact zone 38 be considerably wider than the width CW of end portion 20; and that the width TW of the trough 24 be considerably wider than the width PW of the protrusion 32. The respective widths ZW and TW should be between 50 and 100 percent greater than the widths of CW and PW.

It is understood that preferred embodiments of the present invention are disclosed which achieve the objectives of the invention as set forth above. However, it should be appreciated that this invention may be implemented in forms other than those disclosed. Variations may also be made with respect to the best mode of practicing this invention without departing from the scope of the invention as set forth in the appended claims.

I claim:

1. A substantially waterproof construction comprising:

a pair of substantially like panels having opposite ends respectively defined as a connector end and a receiver end; said connector end of said panels having a longitudinally extending upper surface defining a longitudinal extending contact area, and an upstanding sealing member adjacent said contact area; said receiver end of said panel having a longitudinally extending lower surface defining a longitudinally extending contact area; fulcrum means provided on said receiver end to move said upstanding sealing member into sealing engagement along said contact area of said receiver end responsive to assembly of said panels.

2. A construction as set forth in claim 1 wherein said longitudinally extending contact area of said connector end defines a trough having said upstanding sealing member forming a side of said trough, and wherein said upstanding sealing member is deformable.

3. A construction as set forth in claim 1 wherein said contract area of said receiver end is deformable and forms an inverse trough.

4. A construction as set forth in claim 1 wherein said connector end and said receiver end include means to provide for relative lateral movement between said panels without loss of said sealing engagement.

5. A construction as set forth in claim 1 wherein said fastening means are attached to said fulcrum means for attachment of said receiver end to a supporting structure.

6. An elongated panel adapted for interconnection to a like panel comprising:

a laterally extending platform having a top surface, and a bottom surface which defines a laterally extending plane, and a connector end and a receiver end at laterally opposite edges thereof; said connector end having an upwardly extending contact, said receiver end having a downwardly facing contact zone on said bottom surface; a support leg attached at one end thereof to said platform laterally inwardly from said contact zone and extending downwardly from said platform; base plate means attached to the distal end of said support leg in generally perpendicular relation thereto and extending laterally outwardly beyond said receiver end; and a vertically extending fulcrum attached to said base plate laterally outwardly from said contact zone and terminating generally at said laterally extending plane; said connector end being adapted for mating and sealing connection with the receiver end of a like panel, and said receiver end being adapted for mating and sealing connection with the connector end of a like panel.

7. A panel as set forth in claim 6 wherein said base plate means extends laterally outwardly from said fulcrum so as to form a fastener portion.

8. A panel as set forth in claim 7 wherein an intermediate support bracket extends downwardly from the bottom surface of said platform intermediate said support leg and said connector and terminates with a pad on the distal end thereof.

9. A panel as set forth in claim 6 wherein said contact extends above said laterally extending plane and wherein said contact is adapted for deformation for providing a sealing relationship with said contact zone.

10. A panel as set forth in claim 6 wherein said support leg, said base plate means and said fulcrum combine to form a channel beneath said contact zone.

11. An elongated panel adapted for interconnection to a like panel comprising:

a laterally extending platform having a connector end and a receiver end at laterally opposite edges thereof, said platform having a top surface, and a bottom surface which defines a bottom plane, said connector end having a downwardly extending shank, a trough extending laterally outwardly from said shank and an upwardly extending end portion terminating with a connector contact above said bottom plane, said receiver end having a protrusion extending downwardly below the bottom surface of said platform, a receiver contact zone on said bottom surface and laterally inward from said protrusion; a support leg attached at one end thereof to said platform laterally inwardly from said receiver contact zone and extending downwardly from said platform, base plate means attached to the distal end of said support leg in generally perpendicular relation thereto and extending laterally inwardly and outwardly therefrom; and a vertically extending fulcrum attached to said base plate means laterally outwardly from said receiver end and terminating generally at said bottom plane; said connector end being adapted for mating connection with the receiver end of a like panel and said receiver end being adapted for mating connection with the connector end of a like panel.

12. A panel as set forth in claim 11 wherein said support leg, said base plate means and said fulcrum combine to form a channel below said receiver.

13. A panel as set forth in claim 11 wherein the connector contact, the protrusion, the trough and the receiver contact zone each have a predetermined lateral width, and wherein the lateral width of said trough exceeds the width of said protrusion by between 50 and 100 percent and wherein the lateral width of said receiver contact zone exceeds the width of said connector contact by between 50 and 100 percent.

14. A panel as set forth in claim 11 wherein means are provided for lateral movement between said panel and a like panel to which said panel may be connected.

15. A panel as set forth in claim 11 wherein said support leg, said base plate means and said fulcrum are interconnected so as to form a drain channel.

16. A panel as set forth in claim 11 wherein said base plate means extends laterally outwardly from said fulcrum so as to form a fastener plate.

17. A panel as set forth in claim 16 wherein said fastener plate is provided with attachment means for attachment of said fastener plate to a supporting structure.

18. A panel as set forth in claim 17 wherein said attachment means is a plurality of apertures formed in said fastener plate.

19. A panel as set forth in claim 11 wherein said top surface includes nonskid means.

20. A panel as set forth in claim 19 wherein said nonskid means includes a plurality of longitudinally extending raised portions.

* * * * *